United States Patent [19]

Davis

[11] Patent Number: 4,741,436

[45] Date of Patent: May 3, 1988

[54] MULTICELL CARRIER AND METHOD OF FORMING THE SAME

[75] Inventor: Robert E. Davis, Nutley, N.J.

[73] Assignee: Federal Paper Board Company, Inc., Montvale, N.J.

[21] Appl. No.: 44,040

[22] Filed: Apr. 30, 1987

[51] Int. Cl.[4] ..... B65D 5/32; B65D 5/48; B65D 85/72; B31B 11/00

[52] U.S. Cl. ..... 206/178; 229/DIG. 9; 493/76; 493/90; 493/391

[58] Field of Search ..... 206/176–179, 206/200; 229/28 BC, 52 BC, DIG. 9; 493/76, 88, 90, 91, 379, 391, 909

[56] References Cited

U.S. PATENT DOCUMENTS

| | | | |
|---|---|---|---|
| Re. 29,063 | 12/1976 | Graser | 206/178 |
| 2,665,049 | 1/1954 | George | 206/200 |
| 3,070,258 | 12/1962 | Engel | 206/178 |
| 3,266,663 | 8/1966 | Ringler | 206/178 |
| 3,581,933 | 6/1971 | Engdahl, Jr. | 206/178 |
| 3,721,368 | 3/1973 | Arneson | 229/DIG. 9 |
| 3,917,059 | 11/1975 | Wood | 229/DIG. 9 |
| 4,469,222 | 9/1984 | Graser | 206/178 |
| 4,549,650 | 10/1985 | Champlin | 206/179 |

FOREIGN PATENT DOCUMENTS

| | | | |
|---|---|---|---|
| 2086350 | 5/1982 | United Kingdom | 229/28 BC |

*Primary Examiner*—Stephen Marcus

*Attorney, Agent, or Firm*—Charles E. Brown; Charles A. Brown

[57] ABSTRACT

This relates to a multicell carrier which is advantageously formed from two separate generally rectangular blanks as opposed to a single generally L-shaped blank. By forming the carrier from two separate blanks, each of which is generally rectangular, a maximum board usage may be obtained and at the same time board is available, without waste, for forming handle reinforcing flaps. In addition, by providing two separate blanks and effecting the simultaneous folding of the two blanks, although the two blanks must be joined in the forming of a carrier, greater glue and folding speed is obtainable as compared to the forming of a like carrier from a single L-shaped blank. A particular feature of the carrier is that a body blank is provided which will not form the entire body of the carrier and a combined divider and handle blank will be provided with a body panel which will be joined to opposite ends of the body blank to complete the carrier body and at the same time provide a secure connection between the two blanks.

11 Claims, 4 Drawing Sheets

MULTICELL CARRIER AND METHOD OF FORMING THE SAME

There has been developed in the past multicell carriers which include a body having a bottom wall defined by two bottom panels which are either adhesively secured together or suitably connected by a lock structure and wherein within the body is a divider which extends between the end walls of the carrier and has transversely extending partition members to divide the body into a plurality of cells. The divider may also have handle forming portions for carrying the carrier.

Prior multicell carriers of the type described above have traditionally been formed from a single piece blank. Such a single piece blank has posed a waste problem. The divider and handle forming portion of the blank is generally at one end of the body forming portion of the blank so that the resultant blank is generally L-shaped. Further, these L-shaped blanks are neither of a size nor a configuration which will permit suitable internesting without a material web loss. With respect to this, it is pointed out that blanks for paperboard carriers are formed from a continuous web of as available width and the individual carrier blanks are printed utilizing a rotary press. In addition, the outline of each web and the various cutouts and fold lines thereof are formed by a rotary combined cutter and ruler to cut and score the web. The diameter of such combined rotary cutter and ruler is restricted thereby limiting the length of a repeating portion of the printed web. This, in turn, restricts the orientation of the carrier blank on the web.

Further, while initially the handle portion of the carrier has been of a two ply construction, it has been found that under certain circumstances, particularly with lighter weight paperboard, the handle has not had sufficient strength. It is therefore frequently desirable to reinforce the handle. Because of the L-shaped configuration of the blank and a desire to internest blanks as much as possible, it has been difficult to find the available board in a convenient location for reinforcing the handle.

Further, in order to transform the flat blank into a knocked-down carrier state, it is necessary to sequentially apply glue to various portions of the blank and to fold the blank. Since the divider and handle forming portions of the blank must have the glue applied thereto and folded first, the forming of the knocked-down carrier is slower than is necessary.

In accordance with this invention, it is proposed to provide an improved multicell carrier wherein the carrier is formed from two separately formed blanks. The blanks include a body blank and a combined divider and handle blank. Each of these blanks is generally rectangular in outline and the body blank is of a length which may be formed utilizing the rotary press and cutter. Thus the two blanks required to form a multicell carrier may be formed with a minimum of board waste. In addition, it is possible to form blanks for receiving bottles of different diameters or different numbers of bottles within the range of the operating conditions of the rotary press and cutter.

More is involved than merely forming a multicell carrier blank in two parts. An advantageous feature of the invention, although the invention is not so limited, is that the combined divider and handle blank will include a panel which is a body panel of the carrier body. This body panel is joined to opposite ends of the body blank and serves to fully anchor one end of the divider with respect to an end wall of the carrier body.

Another desirable, but not absolutely necessary, feature of the invention is that the side and end edges of the handle portion of the combined divider and handle blank are free and may have integrally attached thereto in foldable relation handle reinforcing panels.

Another advantage of the present invention is that in the formation of a carrier in its knocked-down state the combined divider and handle blank is first folded and the two primary panels thereof joined together before it is associated with the body blank so that the carrier forming operation may be effected at a much higher rate. In addition, the blank components are of a readily handleable size so that the gluing and folding operation may be advanced in speed.

With the above and other objects in view that will hereinafter appear, the nature of the invention will be more clearly understood by reference to the following detailed description, the appended claims, and the several views illustrated in the accompanying drawings.

Figure 8:
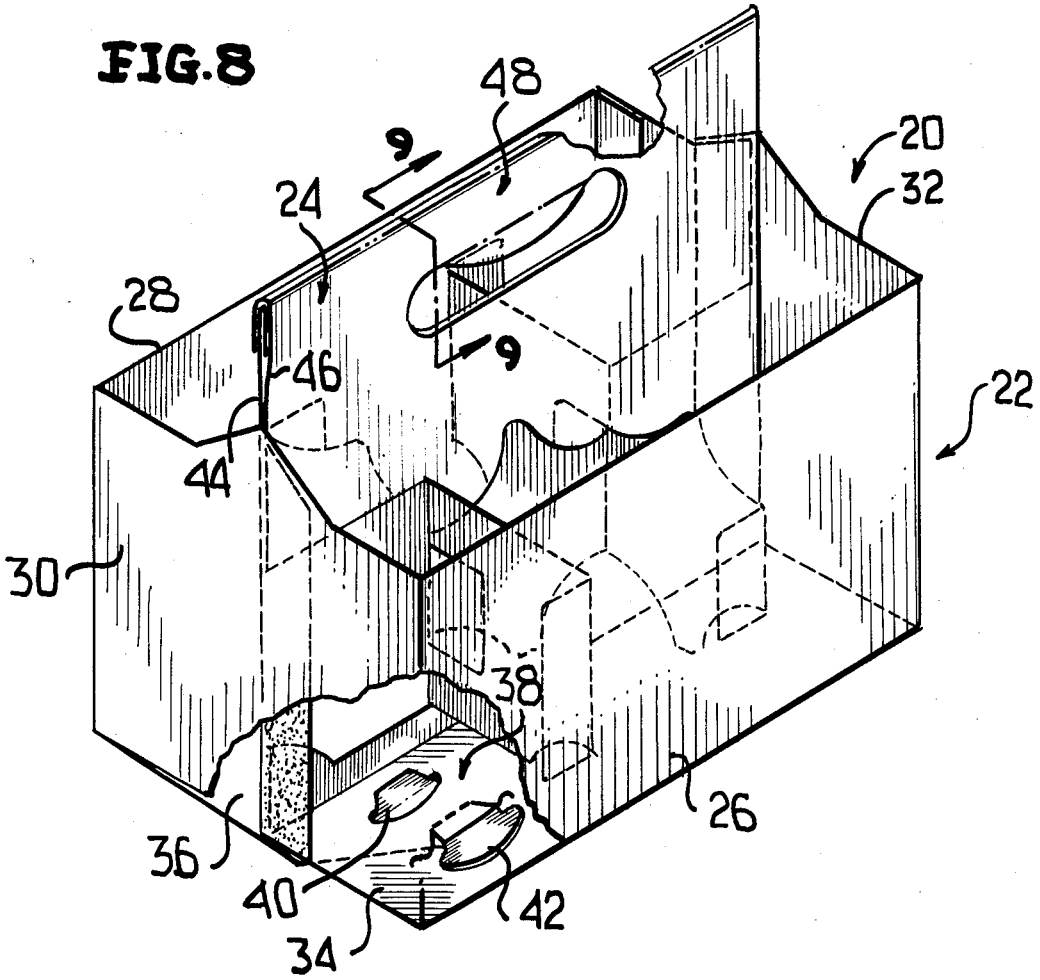
FIG. 8 is a top perspective view with parts broken away and shown in section of a carrier formed in accordance with this invention.

Referring now to the drawings in detail, it will be seen that there is illustrated in FIG. 8 a multicell carrier formed in accordance with this invention, the carrier being generally identified by the numeral 20. Basically the carrier 20 may be divided into two parts. These two parts include a carrier body generally identified by the numeral 22 and a combined divider and handle, generally identified by the numeral 24.

The carrier body 22 is generally in the form of a rectangular box including upstanding side walls or panels 26, 28 joined at their ends by upstanding end walls or panels 30, 32. Bottom panels 34, 36 are hingedly carried by the lower edges of the side walls or panels 26, 28 respectively with the bottom panel 34 being an inner panel and the bottom panel 36 being an outer panel. The panels 34, 36 have overlapped portions which are suitably connected together.

In the illustrated form of the invention, the overlapped portions of the bottom panels 34, 36 are connected together by a plurality of lock arrangements, generally identified by the numeral 38 with each lock arrangement including a primary lock 40 and a secondary lock 42. The lock arrangement 38 in of itself is not novel nor a part of this invention. As a matter of fact, if one so desires, the overlapped portions of the bottom panels 34, 36 may be permanently bonded together utilizing a suitable glue.

The combined divider and handle assembly 24 is formed primarily of two panels 44, 46 which are hingedly connected together and are bonded in face to face relation. The panels 44, 46 extend between the end panels 30, 32 and vertically from the body bottom defined by the bottom panels 34, 36 to a position above the carrier body 22 with the upper portion of the panels 44, 46 forming a handle generally identified by the numeral 48.

Additional structural details of the carrier 20 will be set forth hereinafter.

Figures 3, 4:
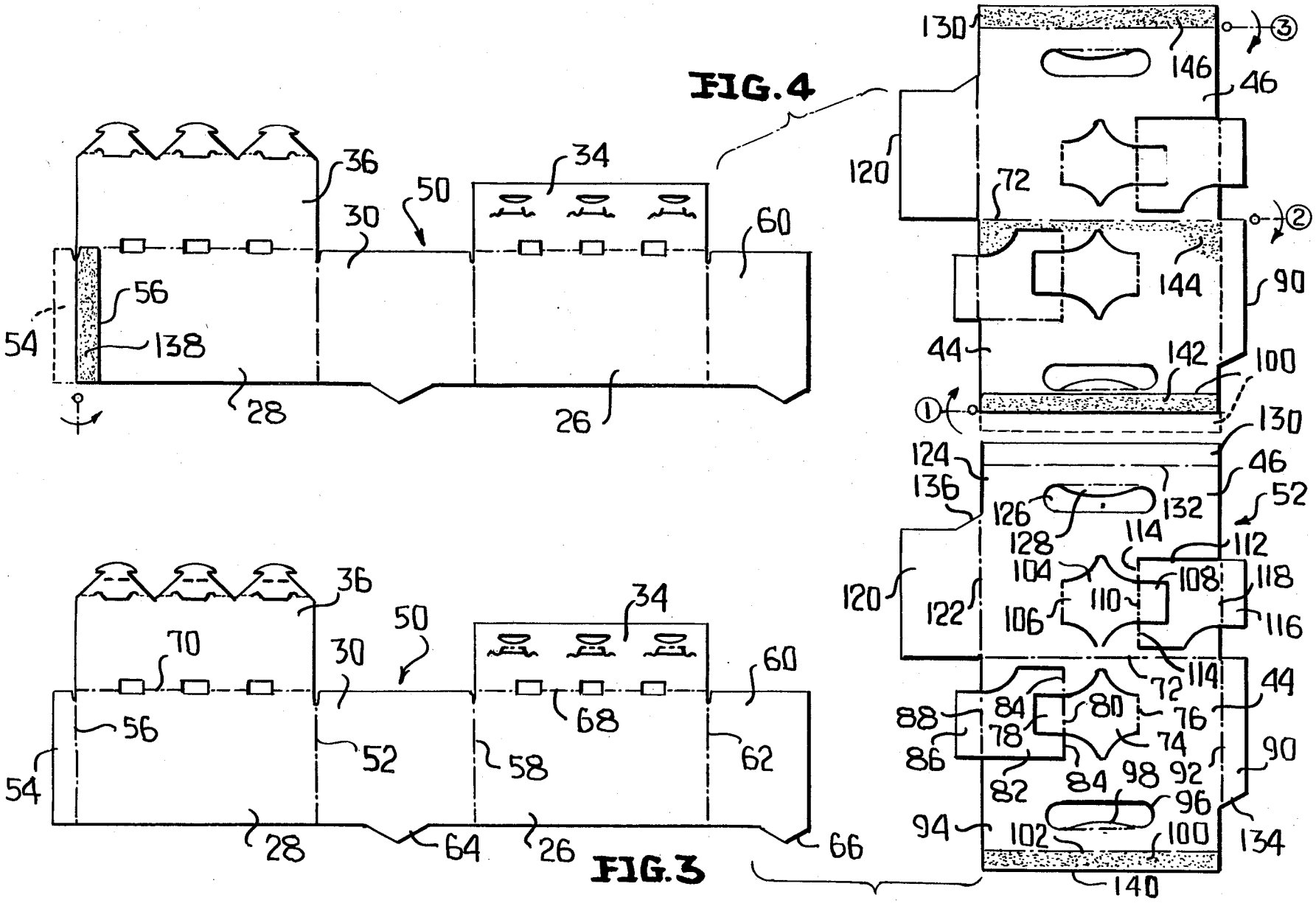
FIG. 3 is an exploded plan view showing a body blank and a combined divider and handle blank in general association with one another in their as formed flat state.
FIG. 4 is a plan view similar to FIG. 3 showing the body blank after a first folding and glue applying step and the combined divider and handle blank showing glue application and folding sequence.

It is to be understood that in accordance with this invention, the carrier body 22 is primarily formed from a body blank 50 which is best illustrated in FIG. 3, and the combined divider and handle assembly 24 is formed from a separately formed combined divider and handle blank 52 which is also best illustrated in FIG. 3.

The body blank 50 will be first described in detail.

The body blank 50 is of an elongated generally rectangular outline and includes a centrally located end panel 30 to which the side wall forming panel 28 is connected along a transverse fold line 52. The panel 28 carries a glue flap 54 which is connected to the panel 28 along a transverse fold line 56. It is to be understood that the glue flap 54 forms one end of the blank 50.

The side wall forming panel 26 is connected to the opposite end of the end panel 30 along a transverse fold line 58. The panel 26 carries an end panel 60 which is connected to the panel 26 along a transverse fold line 62. At this time it is to be noted that the panel 60 is of width to only partially form the end wall 32 of the carrier body 22.

At this time it is pointed out that the upper edge of the end wall forming panel 30 has a generally triangular projection 64. The purpose of this projection will be described in detail hereinafter. In a like manner, the upper edge of the end panel 60 is provided with an upstanding triangular projection 66.

The body blank 50 further includes the bottom panel 34 which is hingedly connected to the side panel 26 along a longitudinal fold line 68 and the bottom panel 36 which is hingedly connected to the side panel 28 along a longitudinal fold line 70. The general details of the lock arrangement 38 are also shown in FIG. 3 but need not be specifically described in that the lock arrangement per se is not part of this invention.

Referring further to FIG. 3, it will be seen that the combined divider and handle blank 52 is also generally rectangular in outline and is formed primarily of the panels 44, 46 which are hingedly connected together along a fold line 72 which extends transversely of the blank 52.

The panel 44 is provided with suitable cut and fold lines so as to define a partition member 74 which is hingedly connected to the panel 44 along a longitudinal fold line 76. The partition member 44 has at a free end thereof a glue flap 78 which is hingedly connected to the partition member 74 along a longitudinal fold line 80.

At one side of the partition member 74 is a second partition member 82 which is also formed from the panel 44. The partition member 82 is connected to the panel 44 along two spaced longitudinal fold line portions 84 and includes at a free end thereof a glue flap 86. The glue flap 86 projects beyond the main part of the panel 44 and is connected to the partition member 82 along a longitudinal fold line 88.

Along the opposite edge of the panel 44 is a glue flap 90 which is hingedly connected to the panel 44 along a longitudinal fold line 92.

The panel 44, remote from the fold line 72, is in the form of a handle portion 94 which is provided with a hand receiving opening 96 into which there projects a cushioning flap 98.

It is to be noted that the handle forming portion 94, since it is disposed remote from the partition members 74, 82, has free edges. In the illustrated embodiment of the invention, along that free edge which is disposed parallel to and remote from the fold line 72 there is a reinforcing flap 100 which is connected to the panel 44 along a transverse fold line 102.

A partition member 104 is formed from the central portion of the panel 46 and is connected to the panel 46 along a longitudinal fold line 106. The partition member 104 is similar to the partition member 74 but extends in the opposite direction. The partition member 104 also terminates in a glue flap 108 which is connected to the partition member 104 along a longitudinal fold line 110.

The panel 46 is also provided with cut and hinge lines to define a partition member 112 which corresponds to the partition member 82, but also projects in the opposite direction. The partition member 112 is hingedly connected to the panel 46 along longitudinally spaced hinged lines 114 and is provided at the opposite end thereof with a glue flap 116. The glue flap 116 projects beyond the normal outline of the panel 46 and is connected to the partition member 112 along a longitudinal fold line 118.

The edge of the panel 46 remote from the glue flap 116 is provided with a projecting panel 120 which is in the form of a partial body panel. The panel 120 is connected to the edge of the panel 46 along a longitudinal fold line 122.

Like the panel 44, that portion of the panel 46 disposed remote from the fold line 72 is in the form of a handle portion 124. The handle portion 124 includes a hand receiving cutout 126 into which a cushioning flap 128 projects.

Like the handle portion 94, the handle portion 124 has free edges. In the illustrated embodiment of the invention, along that free edge remote from the fold line 72 is a handle reinforcing panel 130 which is connected to the panel 46 along a transverse fold line 132.

Attention is directed to the fact that the end of the glue flap 90 disposed remote from the fold line 72 includes a triangular portion 134 which corresponds to one half of the triangular projection 64. In a like manner, that edge of the body panel 120 disposed remote from the hinge line 72 is provided with a triangular projecting portion 136 which corresponds to one half of the triangular projection 66.

In the forming of the blanks 50, 52 into the carrier 20 in its knocked-down state, the blanks 50, 52 move along parallel paths. The first operation on the blank 50 is the folding of the glue flap 54 into overlying relation with respect to the side wall forming panel 28. Glue is then applied to the glue flap 56 as is shown in FIG. 4, the glue being generally identified by the numeral 138.

In its separate travel, the blank 52 will have glue applied to the reinforcing flap 100 as at 140, as shown in FIG. 3, after which the reinforcing flap 100 is folded into overlying relation to the panel 44 and bonded thereto. Then glue will be applied to the opposite surface of the reinforcing flap 100 as at 142. Other glue will be applied to the panel 44 adjacent the hinge line 72 as at 144. Further glue will be applied to the reinforcing flap 130 as at 146.

After the application of the glue, the panel 46 will be folded into overlying relation with respect to the panel 44 and the glue 144 will bond the two panels together adjacent the hinge line 72 while the glue 142 will bond together free edge portions of the panels. The reinforcing flap 130 will then be folded around the end of the panel 44 with the glue 146 securing it to the panel 44.

At a suitable time, glue will be applied to the undersides of the glue flaps 78, 86 and 90. The folded blank 52 is now ready for application to the blank 50 which remains flat except for the folded over glue flap 54. A free edge portion of the wall panel 120 will bond to the glue flap 54 while the glue flaps 78, 86 will bond to the side wall forming panel 26. Further, the glue flap 90 will bond to the end wall forming panel 30. It is to be noted at this time that the triangular portion 134 is aligned with a respective half of the triangular projecting portion 64.

Glue is now applied to the glue flaps 108, 116. Further, a stripe of glue 148 is applied to a free edge portion of the end wall forming partial panel 60 with the glue 148 covering generally one half of the triangular projection 66. The blank 50 is then folded along the fold line 58 with the side wall forming panel 26 overlying the glue flaps 108, 116 being bonded thereto. At the same time, the free edge portion of the panel 60 having the glue 148 thereon will overlie the wall panel 120 adjacent the hinge line 122 and will bond to the panel 120. At this time, that half of the generally triangular projection 66 containing the glue 148 will become aligned with the generally triangular projection 136 of the panel 120.

At this time it will be seen that by providing the triangular projections 64, 66, 134, 136, the length of the glue connections between the blank 52 and the blank 50 may be increased.

Figure 6:
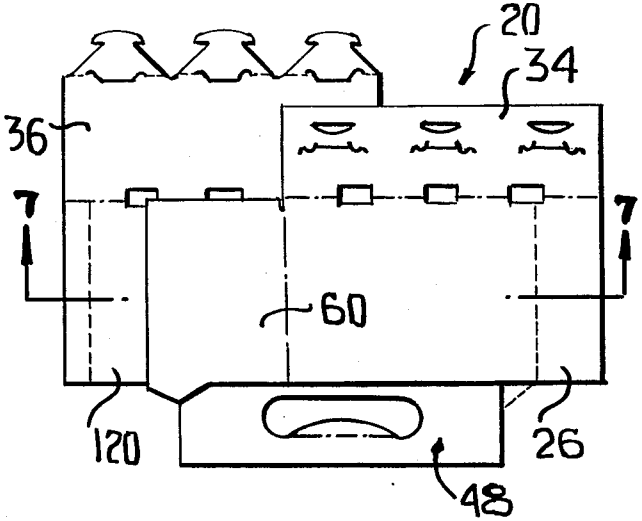
FIG. 6 is a plan view of the completed carrier in its knocked-down state.
Figure 5:
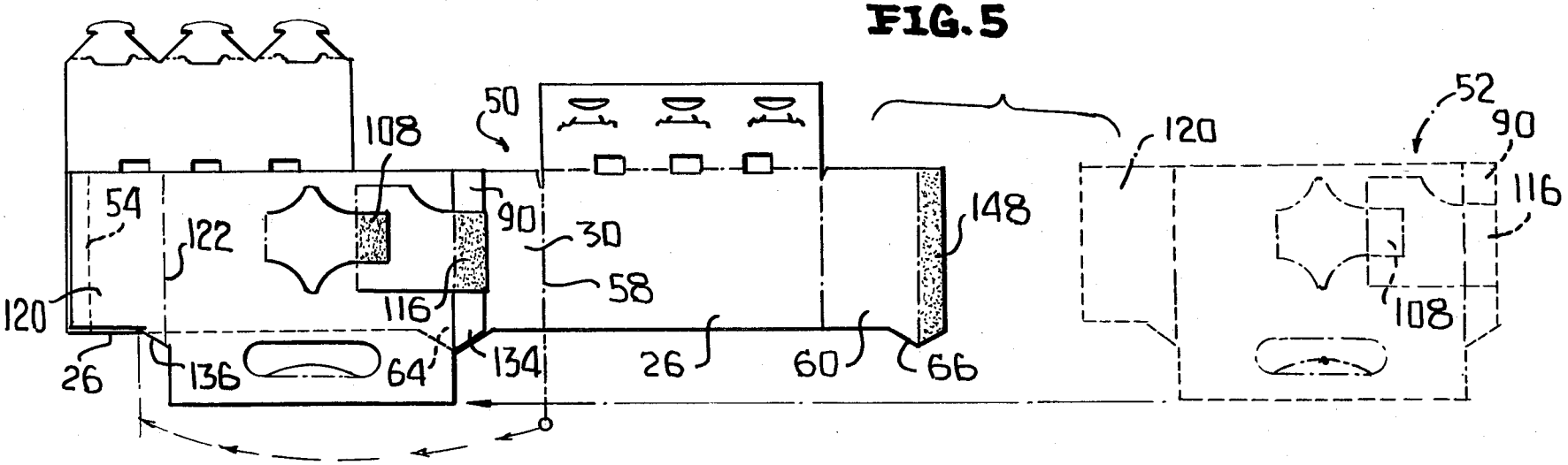
FIG. 5 is yet another plan view similar to FIG. 3 showing in phantom lines the folded and bonded together combined divider and handle blank and the same blank applied to the body blank followed by a further glue application.

With the panels 26 and 60 in their folded positions, the carrier in its knocked-down state is completed and is shown in FIG. 6. The carrier 20 is now ready for erection.

Figure 7:
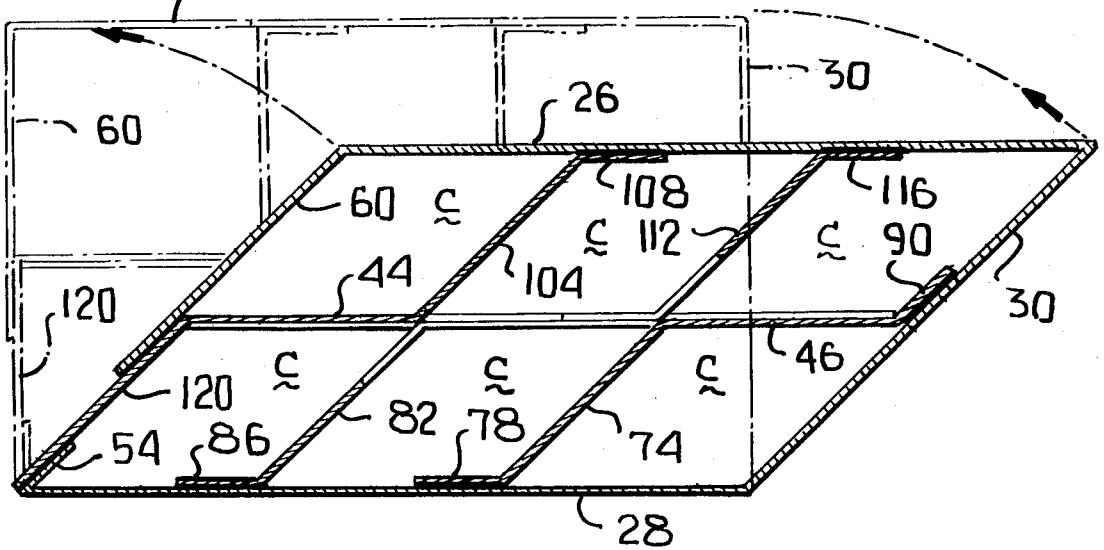
FIG. 7 is a schematic transverse vertical sectional view taken generally along the line 7—7 of FIG. 6 and shows the manner in which the knocked-down carrier of FIG. 6 may be erected, the view also showing the manner in which the divider is secured to the carrier body.

When it is desired to erect the carrier 20, the side wall forming panels 26, 28 are moved apart generally in the direction of the arrow of FIG. 7 from a substantially flat state to an upstanding state wherein a plurality of individual bottle receiving cells C are formed. Next, the bottom forming panels 34, 36 are folded in place in sequence and the lock assembly 38 is engaged as is shown in FIG. 8. The carrier 20 is now fully assembled ready to receive bottles.

Figure 9:
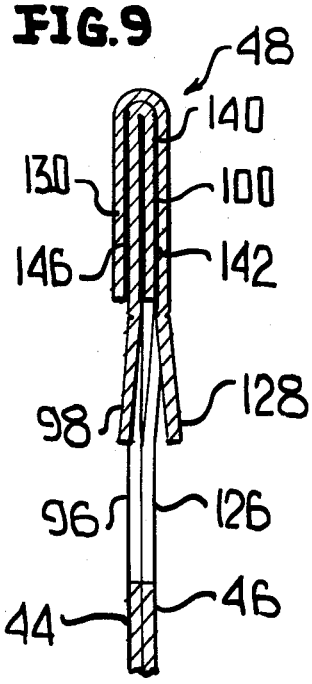
FIG. 9 is an enlarged fragmentary vertical sectional view taken through the carrier handle generally along the line 9—9 of FIG. 8 and shows specifically the handle reinforcement.
Figure 10:
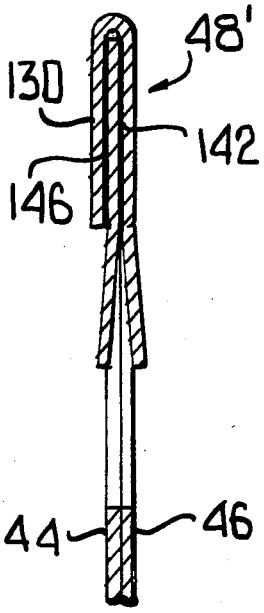
FIG. 10 is a sectional view similar to FIG. 9 wherein only one reinforcing panel is utilized.

Reference is now made to FIG. 9 wherein it will be seen that the handle portion 48 is reinforced by the reinforcing flaps 100, 130 and is thus of a four ply construction. This provides adequate strength to the handle defining portion 48 so that in the event the carrier 20 is exposed to moisture, the handle will not be unduly weakened and fail. There are instrances where four ply handle forming portions are not required. Accordingly, when desired, the reinforcing flap 100 may be eliminated in which event the glue 140 will also be eliminated and the glue 142 will be applied directly to a terminal edge portion of the panel 44. The glue 146 will be applied to the reinforcing flap 130 in a normal manner and serve to bond the reinforcing flap 130 to the panel 44 while the glue 132 bonds the panels 44, 46 directly together.

A modified form of handle forming portion 40' will then be of a three ply construction.

It is also to be understood that in a manner not shown, one may eliminate the reinforcing flap 130 and the glue 146 with the handle forming portion being of a two ply construction.

Figure 11:
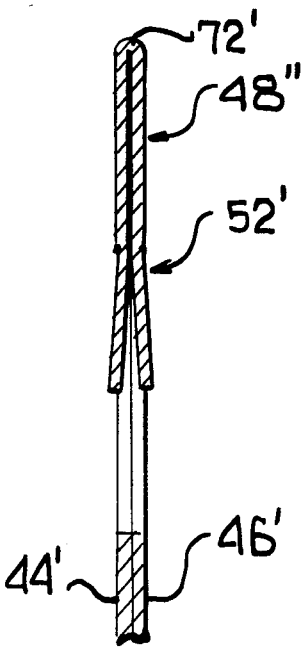
FIG. 11 is another sectional view through the carrier handle wherein the handle is only of a two ply construction and the fold between the divider panels is at the top instead of at the bottom.

Further, if the handle forming portion is to be of a two ply construction, as shown by the handle forming portion 48'' of FIG. 11, the blank 52 may be modified to become a blank 52' wherein in lieu of the lower edges of the panels 44, 46 being directly joined together, the handle forming portions may be next to one another and modified panels 44', 46' may be joined in the handle forming portion 48'' along a hinge or fold line 72', as is clearly shown in FIG. 11.

Figure 1:
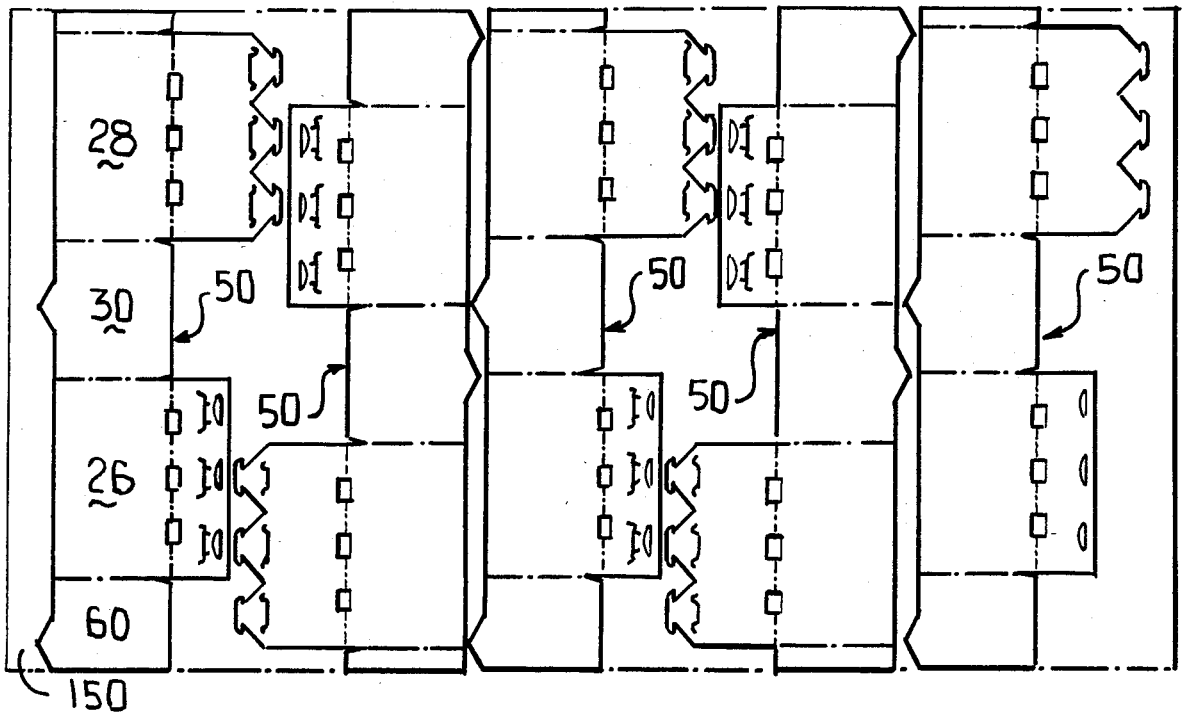
FIG. 1 is a plan view of a repeatable portion of a web having formed therein carrier body blanks in accordance with this invention.

Referring now to FIG. 1 in particular, it will be seen that a plurality of the body blanks 50 is formed in side-by-side relation from a web 150 of a conventional width. The lengths of the blanks 50 correspond to the length of a repeat panel for a rotary press and rotary cutter. With the conventional width web 150, five of the blanks 50 may be disposed in side-by-side relation. Thus, for all practical purposes, there will be minimal waste between adjacent blanks 50 and substantially no waste between ends of adjacent blanks 50 and repeat panels. It is also to be understood that in the event a body blank 50 is to be utilized in conjunction with a carrier for larger diameter bottles, the lengths of such body blanks may be increased to provide for longer panels 26, 28, 30 and 60. All that is necessary is to increase the length of the repeat panel of the respective rotary press and rotary cutter. In a like manner, if the number of bottles or like containers is to be increased from the six illustrated in the example form of the invention to eight, the lengths of the body blanks 50 may be increased to provide for longer panels 26, 28.

Figure 2:
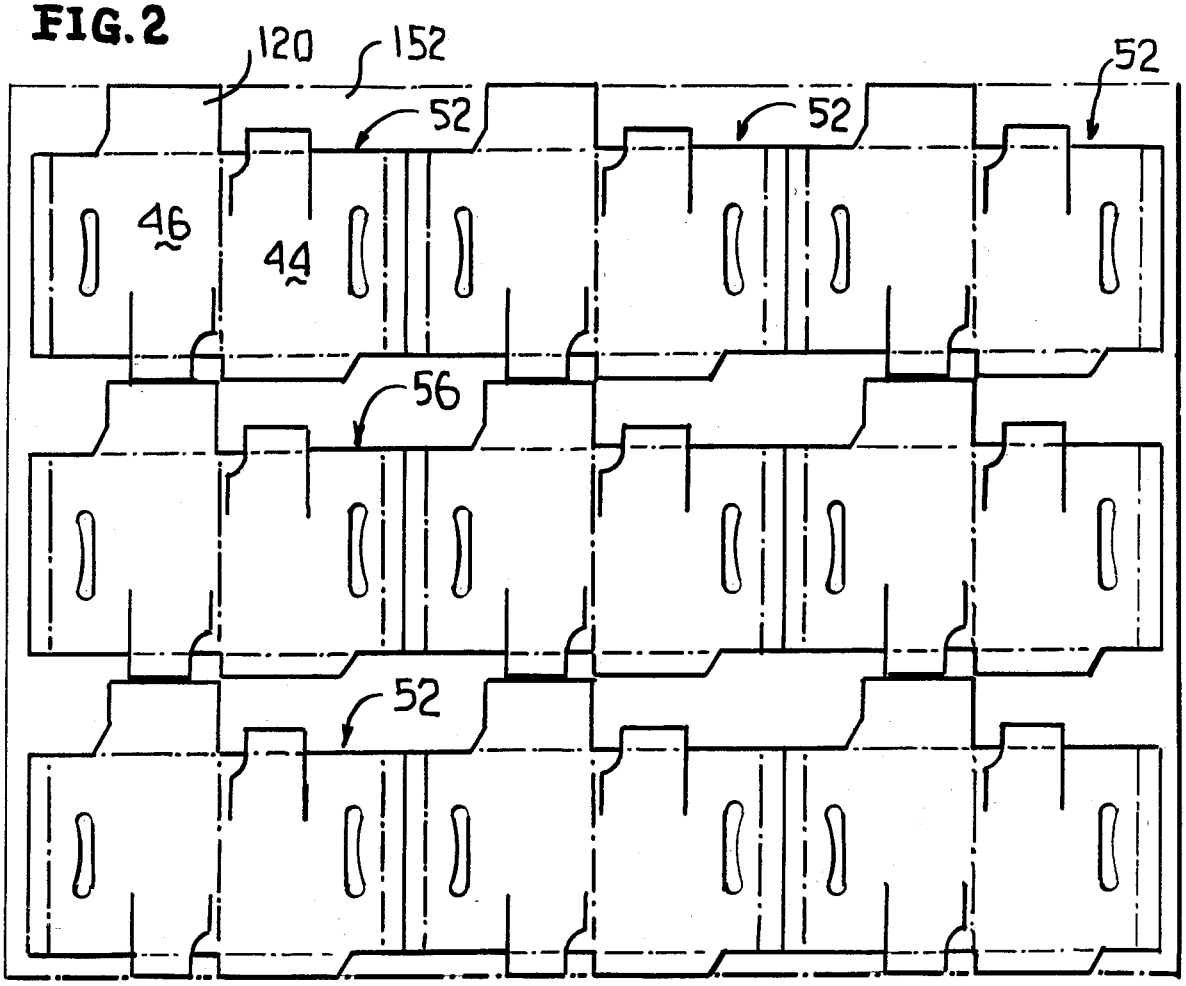
FIG. 2 is a plan view similar to FIG. 1 showing a repeatable portion of a web having formed therein combined divider and handle blanks for carriers in accordance with this invention.

Referring now to FIG. 2, it will be seen that there is illustrated a further web 152, which may be of the same width as the web 150 wherein an associated rotary press and rotary cutter (not shown) is set up to provide the blanks 52 three across and three in a repeat panel with a minimum waste. Thus nine combined divider and handle blanks 52 may be formed in each repeat panel of the web 152.

In a like manner, the widths of the panels 44, 46 and 120 may be increased to compensate for larger diameter containers or a larger number of containers.

It will also be apparent from FIG. 2 that the side edges of the panels 44, 46 in the handle forming area are also free and that it is feasible for handle reinforcing flaps to be formed on the side edges of the panels 44, 46 as opposed to being formed on the end edges.

Although only a preferred embodiment of multicell carrier and the method of forming the same from two blanks has been illustrated and described, it is to be understood that minor variations may be made in the configuration of the blanks and thus the resultant multicell carrier without departing from the spirit and scope of the invention as defined by the appended claims.

I claim:

1. A method of forming a multicell carrier of the type including a body, internal dividers and a handle, said method comprising the steps of forming a body blank and separately forming a combined divider and handle blank, and joining said combined divider and handle blank to said body blank to form a knocked-down multicell carrier, each of said blanks being provided in a flat state, and said combined divider and handle blank including a central divider portion and remote handle portions with said divider portion being centrally folded upon itself with said remote handle portions joining together to form a rigid handle structure before said blanks are joined together.

2. A method according to claim 1 wherein an edge portion of said folded combined divider and handle blank is positioned in overlying relation to an end portion of said body blank and said edge portion of said combined divider and handle blank is then joined to said end portion of said body blank.

3. A method according to claim 2 wherein said body blank is next folded over into overlying relation to said folded combined divider and handle blank and portions of the then upper surface of said combined divider and handle blank are joined to said folded over body blank portion to complete said knocked-down multicell carrier.

4. A method of forming a multicell carrier of the type including a body, internal dividers and a handle, said method comprising the steps of forming a body blank and separately forming a combined divider and handle blank, and joining said combined divider and handle blank to said body blank to form a knocked-down multicell carrier, each of said blanks being provided in a flat state, and said combined divider and handle blank being centrally folded upon itself with free end portions joining together to form a rigid handle structure before said blanks are joined together, said body blank being formed to include a plurality of body panels connected together along fold lines, said body panels including remote ends with said remote ends being spaced apart in a folded state of said body blank, said combined divider and handle blank being provided with a projecting body panel, and securing said projecting body panel to said remote ends in bridging relation.

5. A method of forming a multicell carrier of the type including a body, internal dividers and a handle, said method comprising the steps of forming a body blank and separately forming a combined divider and handle blank, and joining said combined divider and handle blank to said body blank to form a knocked-down multicell carrier, said body blank being formed to include a plurality of body panels connected together along fold lines, said body panels including remote ends with said remote ends being spaced apart in a folded state of said body blank, said combined divider and handle blank being provided with a projecting body panel, and securing said projecting body panel to said remote ends in bridging relation.

6. A method of forming a multicell carrier of the type including a body, internal dividers and a handle, said method comprising the steps of forming a body blank and separately forming a combined divider and handle blank, and joining said combined divider and handle blank to said body blank to form a knocked-down multicell carrier, said blanks being separately formed from different webs with said body blank being elongated in a longitudinal web direction and said combined divider and handle blank being elongated in a transverse web direction.

7. A multicell carrier comprising a generally rectangular body defined by end and side walls and a bottom wall, an upstanding divider positioned within said body and extending between and secured to said end walls, said divider including projecting partition members secured to said side walls and an upper handle portion formed integrally with said divider, said carrier being improved by said body being formed from a body blank and said divider and said handle being formed from a separately formed combined divider and handle blank, said body blank having spaced apart ends disposed along one of said body walls, and said combined divider and handle blank including a body panel at one end of said divider extending between and joined to said body blank ends to complete said one body wall and to in part join said combined divider and handle blank to said body blank.

8. A multicell carrier according to claim 7 wherein said one body wall is an end wall.

9. A multicell carrier according to claim 7 wherein said one body wall is an end wall, and said divider has a glue flap secured to the other of said end walls.

10. A multicell carrier according to claim 7 wherein said one body wall is an end wall formed by three serially formed end wall panel portions including two outermost end wall panel portions spaced from one another and connected to one another by a middle one of said serially connected end wall panel portions, said middle one of said serially connected end wall panel portions being said body panel at one end of said divider.

11. A multicell carrier according to claim 10 wherein said two outermost end wall panel portions are formed from said erected body blank.

* * * * *